United States Patent [19]

Buchschmid et al.

[11] Patent Number: 4,926,150

[45] Date of Patent: May 15, 1990

[54] ELECTROMAGNETIC RELAY

[75] Inventors: Emil Buchschmid, Rosstal; Anton Frenznick, Nuremberg; Klaus Lindner, Zirndorf; Olaf Schmid, Schwabach; Hans-Dieter Schmid, Nuremberg; Gerhard Schmidt, Weihenzell; Theodor Sturm, Sachsen, all of Fed. Rep. of Germany

[73] Assignee: Robert Bosch GmbH, Stuttgart, Fed. Rep. of Germany

[21] Appl. No.: 343,258

[22] PCT Filed: Oct. 24, 1987

[86] PCT No.: PCT/DE87/00481

§ 371 Date: Apr. 14, 1989

§ 102(e) Date: Apr. 14, 1989

[87] PCT Pub. No.: WO88/04466

PCT Pub. Date: Jun. 16, 1988

[30] Foreign Application Priority Data

Dec. 1, 1986 [DE] Fed. Rep. of Germany ..... 3640997

[51] Int. Cl.[5] ..... H01H 1/00

[52] U.S. Cl. ..... 335/196; 335/273; 200/251

[58] Field of Search ..... 335/78–83, 335/128, 133, 270, 273–276; 200/251

[56] References Cited

U.S. PATENT DOCUMENTS

| | | | |
|---|---|---|---|
| 1,699,858 | 1/1929 | Russell | 200/251 |
| 2,916,580 | 12/1959 | Seele | 335/273 |
| 4,224,488 | 9/1980 | Rossi | 200/251 |
| 4,851,802 | 7/1989 | Koelling | 335/274 |

FOREIGN PATENT DOCUMENTS

| | | |
|---|---|---|
| 0110132 | 6/1984 | European Pat. Off. . |
| 2145584 | 3/1973 | Fed. Rep. of Germany . |
| 2072949 | 8/1981 | United Kingdom . |

*Primary Examiner*—Leo P. Picard
*Assistant Examiner*—Lincoln Donovan
*Attorney, Agent, or Firm*—Michael J. Striker

[57] ABSTRACT

An electromagnetic relay comprising a hinged armature pivotably supported at a front face of a coil core carrying a relay winding, a switching contact supported on the hinged armature, a fixed counter contact cooperating with the switching contact for actuating the electromagnetic relay, and contact carrier for supporting the fixed counter contact and having a first portion including a center leg and two outer legs arranged on opposite sides of the center leg in spaced relationship relative thereto, a crossbar connecting the center and outer legs at one end thereof, the center leg having at an end thereof spaced from the crossbar a bent-away portion for supporting the one fixed counter contact, the first portion further including in the vicinity of the bent-away portion of the center leg laterally symmetrically extending webs for connecting the center leg to the outer legs, respectively, the center leg having a stretchable portion located between the crossbar and the connecting webs for adjusting a posiiton of the fixed counter contact relative to the switching contact.

4 Claims, 2 Drawing Sheets

ELECTROMAGNETIC RELAY

BACKGROUND OF THE INVENTION

The invention relates to an electromagnetic relay.

In such a known electromagnetic relay (British Patent 2,072,949), the switching contact of the relay, arranged on a hinged armature, operates in conjunction with a fixed normally-open contact which must be set to a predetermined contact pressure when the relay is switched on and to a particular contact spacing when the relay is switched off. For this purpose, the contact carrier of the normally open contact has an area which is bent away at a right angle next to the normally-open contact, and is provided with at least one notch for stretching this area of the contact carrier in the known electromagnetic relay. Dependent on the number and depth of the notches, the normally-open contact is selectively moved towards the switching contact of the hinged armature until the required relay data such as erosion reserve, contact pressure and contact spacing are achieved.

However, the disadvantageous factor in this solution is that due to the notching process, the normally-open contact is not always accurately raised with parallel faces to the switching contact of the hinged armature. Instead, the normally-open contact can also be slightly tilted sideways or towards the rear due to a non-uniformly hard structure in the material of the contact carrier, which can then lead to an unwanted unilateral resting of the switching contact against the normally-open contact and leads to more rapid contact erosion. During the notching of the contact carrier, considerable tool forces also become effective over its entire width which must be absorbed by a stable support at the rear of the contact carrier in order to avoid damaging the relay. The space required for this, however, exists only in the case of power relays with relatively large dimensions so that the known solution cannot be implemented either because of lack of space in the production of relatively small relays. In this connection, the application of several notches for a required stretching of the contact carrier is particularly expensive, since several operating cycles are required for each notching process, such as setting notching level, measuring, applying stamp dye, stamping, retracting stamp dye.

The present solution attempts to carry out the stretching of the contact carrier for setting up the relay contact even in narrow space conditions in such a symmetrical manner that tilting away of the relay contact to the side or to the rear is avoided during this process.

SUMMARY OF THE INVENTION

The object of the invention is to provide an electromagnetic relay in which a square displacement with parallel faces of the relay contact towards the switching contact on the hinged armature of the relay is ensured during the stretching of the centre leg of three adjacently extending legs of the contact carrier lateral connecting webs. Lateral tilting or offsetting of the relay contacts is thereby reliably prevented. It must be considered as a further advantage that due to the relatively small cross-section of the centre leg of the contact carrier, the relay contact can be set within a short time with little force expenditure using a stamping process so that this solution can also be implemented with a high accuracy of setting even for very small relays.

It is particularly advantageous to provide the center leg of the contact carrier with stampings on both sides in its stretching zone, because during this process the stamping forces directed against each other are absorbed by the stamping tool itself and because, as a result, an additional counter support can be omitted. To ensure that the center leg is symmetrically guided by the stamping to a maximum stretching of approximately 1.1 mm, the webs are conducted away from the center leg to the outer legs at an angle pointing shallowly downwards from the horizontal on both sides in their initial position. In addition, the stability is increased for the three legs of the contact carrier if the outer legs lead to a connecting part anchored in the base plate at their ends facing away from the yoke.

The present invention as to its construction so to its mode of operation, together with additional objects and advantages thereof, will be best understood from the following description of the preferred embodiment with reference to the appended drawings.

DESCRIPTION OF THE PREFERRED EMBODIMENT

Figure 1:
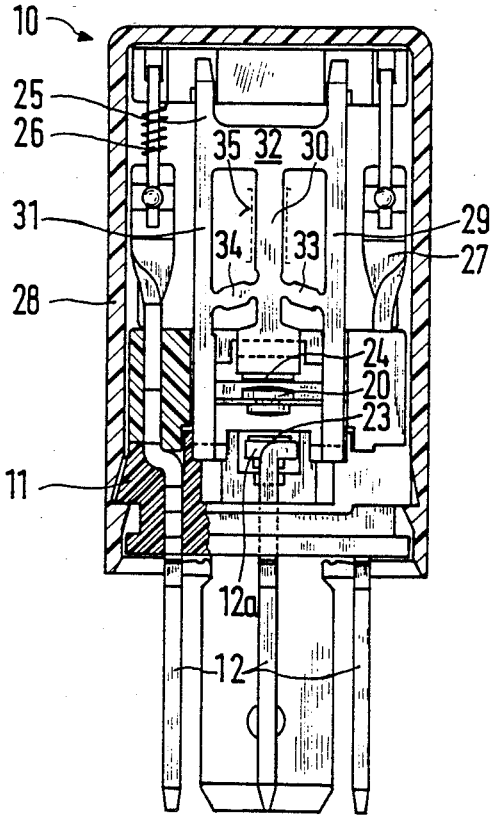
FIG. 1 shows a partially cross-sectional side-view a hinged-armature relay according to the present invention.
Figure 2:
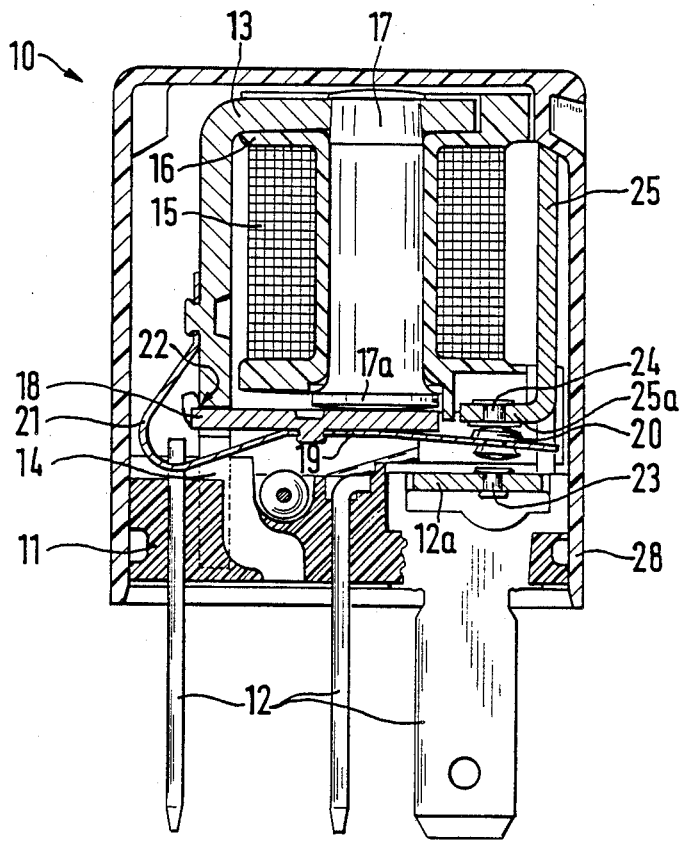
FIG. 2 shows a longitudinal cross-section of the relay shown in FIG. 1.

In FIGS. 1 and 2, a hinged-armature relay for motor vehicles, operating as change-over relay, is shown enlarged and designated by 10. The relay 10 is provided with a base plate 11 of insulating material, in which several connecting blades 12 forming the connecting parts of the relay are mounted. The base plate 11 also carries an L-shaped magnetic yoke 13 which is anchored by mounting tongues 14 at one face end in corresponding pockets of the base plate 11. A relay winding 15 is placed on a coil former 16 which is carried by a coil core 17. The upper end of the coil core is rivetted to the magnetic yoke 13. In front of the bottom end **17*a* of the coil core 17, a hinged armature 18 is arranged which is rotatably supported at one end on the magnetic yoke 13. A leaf spring 19, the free end of which projecting past the end of the hinged armature 18 carries a switching contact 20, is fixed to the hinged-armature 18. The other end of the leaf spring 19 is bent in a hairpin-shaped curl 21 around a support point 22 of the hinged armature 18 on the magnetic yoke 13 and fixed with corresponding pretension to the magnetic yoke 13 to provide a return force for the hinged armature. The switching contact 20 interacts with two fixed counter contacts, a normally-closed contact 23 which is fixed to an area 12*a*, which is bent away above the base plate 11, of the right-hand connecting blade 12 in FIG. 2. The other counter contact is a normally-open contact 24 which is fixed to an end 25*a*, bent away at a right angle, of a contact carrier 25. The ends of the relay winding 15 are in each case soldered to a connecting wire 26 attached to the coil former 16. The upper end of the two connecting wires 26 is in each case welded to a connecting tab 27 which is in each case formed integrally with the top section of one of the connecting blades 12. The leaf spring 19 is also electrically connected to a connecting blade 12 for connecting the switching contact 20. A base plate 11 is surrounded by a housing 28** made from an insulating material and surrounding the magnetic system and the relay contacts.

FIG. 1 shows the relay 10 with the hinged-armature 18 attracted, in which arrangement the normally-open contact 24 is not yet set. In FIG. 1, it is still spaced from the switching contact 20 of the hinged-armature 18. To set the required erosion reserve and the required contact force with the hinged-armature 18 attracted, the normally-open contact 24 must be moved downwards towards the switching contact 20 until it has reached the set position shown in FIG. 2. For this purpose, the contact carrier 25 is provided, above the normally-open contact 24, with three legs 29, 30 and 31 which extend adjacent to one another at a distance, and the upper ends of which are connected to a common crossbar 32, and the centre leg 30 of which carries the bent-away normally-open contact 24. In addition, the centre leg 30 is connected on both sides to the two outer legs 29 and 31 with symmetrically projecting connecting webs 33, 34. Between the common crossbar 32 and the connecting webs 33 and 34, the centre leg 30 has a stretching zone 35 by which the normally-open contact 24 can be set relative to the switching contact 20 in the axial direction of the leg 30.

Figure 3:
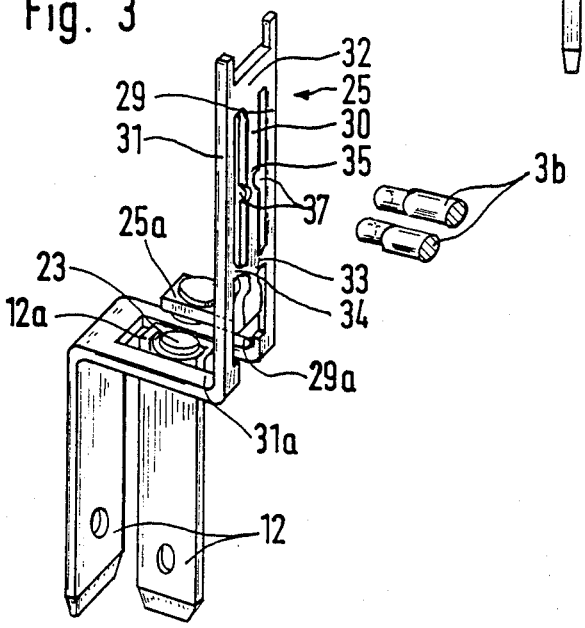
FIG. 3 shows the respective view of the contact carrier of the relay in a stereographic.

FIG. 3 shows the centre leg 30 provided, in the stretching zone 35, with bilateral stampings 37 formed by ends 36 of stamping pliers, by which stampings the centre leg 30 is stretched in the axial direction. The axial displacement of the normally-open contact 24 during the stretching process is ensured by the bilateral connecting webs 33, 34 which extend obliquely from the centre leg 30 towards the outer legs 29 and 31. While the connecting webs 33, 34, in the initial position of the contact carrier 25, at first extend from the centre leg 30 at an angle of 15° from the horizontal downwards towards the outer legs 29 and 31, they are upwardly directed at an angle towards the outer legs 29, 31, with the maximum extension after the stretching of the centre leg 30. This reliably counteracts a springing back of the centre leg 30 at the end of the setting process and minimizes the bowing out of the outer legs 29 and 31 which, in any case, is slight. In this manner, relay contacts can be set inexpensively, rapidly, with high setting accuracy and the least spring-back resilience rates in a narrow space after the complete assembly of the relay.

In addition, the contact carrier 25 can be constructed as one piece together with the center connecting blade 12 with the outer legs 29 and 31, at their ends **29*a* and 31*a*, facing away from the crossbar 32 on extending above the base plate on both sides of the normally-closed contact 23 in the base plate 11. The outer legs are then combined to form an area of the connecting blade 12 anchored in the base plate 11**.

While the invention has been illustrated and described as embodied in an electromagnetic relay, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electromagnetic relay comprising a base plate made of insulating material; a magnetic yoke supported on said base plate; a coil core supported by said magnetic yoke and having a front face; a relay winding carried by said coil core; a hinge armature pivotably arranged at said front face of said coil core; a switching contact supported on said hinged armature; at least one fixed counter contact cooperating with said switching contact for actuating said electromagnetic relay; and a contact carrier supported on said base plate for supporting said one fixed counter contact, said contact carrier including a first portion extending in a direction of movement of said hinged armature and a second portion bent away at a right angle relative to said first portion for supporting said one fixed counter contact, said first portion having a stretchable zone for adjusting a position of said one fixed counter contact relative to the switching contact, said first portion including a center leg and two outer legs arranged on opposite sides of said center leg in spaced relationship relative thereto, a crossbar connecting said center and outer legs at one end thereof, said center leg having at an end thereof spaced from said crossbar a bent-away portion defining said second portion for supporting said one fixed counter contact, said first portion further including in the vicinity of said bent-away portion of said center leg laterally symmetrically extending webs for connecting said center leg to said center leg respectively, said center leg having a stretchable portion located between said crossbar and said connecting webs and defining said stretchable zone.

2. An electromagnetic relay according to claim 1, wherein said stretchable portion of said center leg has stampings on both sides thereof.

3. An electromagnetic relay according to claim 2, wherein said connecting webs extend at the same angle between said central leg and said outer legs.

4. An electromagnetic relay according to claim 3, further comprising a normally-closed contact, said outer legs at ends thereof having portions extending on opposite sides of said normally-closed contact and merging to form a connecting part attached to said base plate.

* * * * *